US006021859A

United States Patent [19]

Tibbitts et al.

[11] Patent Number: 6,021,859

[45] **Date of Patent: *Feb. 8, 2000**

[54] STRESS RELATED PLACEMENT OF ENGINEERED SUPERABRASIVE CUTTING ELEMENTS ON ROTARY DRAG BITS

[75] Inventors: Gordon A. Tibbitts, Salt Lake City, Utah; Evan C. Turner, The Woodlands, Tex.

[73] Assignee: Baker Hughes Incorporated, Houston, Tex.

[ * ] Notice: This patent is subject to a terminal disclaimer.

[21] Appl. No.: 09/273,676

[22] Filed: Mar. 22, 1999

Related U.S. Application Data

[62] Division of application No. 09/121,456, Jul. 23, 1998, which is a continuation of application No. 08/742,858, Nov. 1, 1996, Pat. No. 5,787,022, which is a division of application No. 08/430,444, Apr. 25, 1995, Pat. No. 5,605,198, which is a continuation-in-part of application No. 08/353,453, Dec. 9, 1994, Pat. No. 5,590,729, and application No. 08/164,481, Dec. 9, 1993, Pat. No. 5,435,403.

[51] Int. Cl.[7] ..... G06F 17/50; G06G 7/48

[52] U.S. Cl. ..... 175/431; 175/50; 364/422; 364/578

[58] Field of Search ..... 175/50, 426, 431; 364/149, 150, 151, 421, 422, 512, 578

[56] References Cited

U.S. PATENT DOCUMENTS

| | | | |
|---|---|---|---|
| 3,727,704 | 4/1973 | Abblanalp . | |
| 4,098,362 | 7/1978 | Bonnice . | |
| 4,109,737 | 8/1978 | Bovenkerk . | |
| 4,303,136 | 12/1981 | Ball . | |
| 4,452,324 | 6/1984 | Jurgens . | |
| 4,478,297 | 10/1984 | Radtke . | |
| 4,478,298 | 10/1984 | Hake . | |
| 4,512,426 | 4/1985 | Bidegaray . | |
| 4,525,179 | 6/1985 | Gigl . | |
| 4,606,418 | 8/1986 | Thompson . | |
| 4,629,373 | 12/1986 | Hall . | |
| 4,784,023 | 11/1988 | Dennis . | |
| 4,794,534 | 12/1988 | Millheim | 364/420 |
| 4,794,535 | 12/1988 | Gray et al. | 364/420 |
| 4,815,342 | 3/1989 | Brett et al. | 364/119 |
| 4,845,628 | 7/1989 | Gray et al. | 364/420 |
| 4,852,671 | 8/1989 | Southland . | |
| 4,858,707 | 8/1989 | Jones et al. . | |
| 4,872,520 | 10/1989 | Nelson . | |
| 4,902,073 | 2/1990 | Tomlinson et al. . | |
| 4,913,244 | 4/1990 | Trujillo . | |
| 4,913,247 | 4/1990 | Jones . | |
| 4,954,139 | 9/1990 | Cerutti . | |
| 4,984,642 | 1/1991 | Renard et al. . | |
| 4,997,049 | 3/1991 | Tank et al. . | |
| 5,007,207 | 4/1991 | Phaal . | |
| 5,010,789 | 4/1991 | Brett et al. | 364/149 |
| 5,011,515 | 4/1991 | Frushour . | |
| 5,025,874 | 6/1991 | Barr et al. . | |

(List continued on next page.)

FOREIGN PATENT DOCUMENTS

| | | |
|---|---|---|
| 0 239 328 | 9/1987 | European Pat. Off. . |
| 0 317 069 | 10/1988 | European Pat. Off. . |
| 0 322 214 | 6/1992 | European Pat. Off. . |
| 2 212 190 | 7/1989 | United Kingdom . |

OTHER PUBLICATIONS

Republic of South Africa Provisional Specification entitled "Composite Abrasive Compact" for De Beer Industrial Diamond Division Limited, Dec. 23, 1992.

"12.5 Electrical and thermal conductivity," pp. 328 and 332.

U.K. Search Report, dated Sep. 16, 1993.

*Primary Examiner*—William Neuder

*Attorney, Agent, or Firm*—Trask, Britt & Rossa

[57] ABSTRACT

A drill bit employing selective placement of cutting elements engineered to accommodate differing loads such as are experienced at different locations on the bit crown. A method of bit design and cutting element design to achieve optimal placement for maximum ROP and bit life of particularly suitable cutting elements for a given bit profile and design, as well as anticipated formation characteristics and other downhole parameters.

10 Claims, 8 Drawing Sheets

U.S. PATENT DOCUMENTS 5,027,912 7/1991 Juergens .
5,028,177 7/1991 Meskin et al. .
5,037,451 8/1991 Burnand et al. .
5,042,596 8/1991 Brett et al. ..... 175/57
5,054,246 10/1991 Phaal et al. .
5,120,327 6/1992 Dennis .
5,131,478 7/1992 Brett et al. .
5,135,061 8/1992 Newton, Jr. .
5,172,778 12/1992 Tibbitts et al. .
5,217,081 6/1993 Waldenstrom et al. .
5,273,125 12/1993 Jurewicz .
5,301,762 4/1994 Besson .
5,316,095 5/1994 Tibbitts .
5,327,984 7/1994 Rasi et al. ..... 175/61
5,351,772 10/1994 Smith .
5,355,969 10/1994 Hardy et al. .
5,373,908 12/1994 Pastusek .
5,377,773 1/1995 Tibbitts .
5,421,425 6/1995 Griffin .
5,605,198 2/1997 Tibbitts et al. .
5,787,022 7/1998 Tibbitts et al. ..... 364/578

12

STRESS RELATED PLACEMENT OF ENGINEERED SUPERABRASIVE CUTTING ELEMENTS ON ROTARY DRAG BITS

CROSS REFERENCE TO RELATED APPLICATION

This application is a divisional of application Ser. No. 09/121,456, filed Jul. 23, 1998, pending, which is a continuation of U.S. patent application Ser. No. 08/742,858, filed Nov. 1, 1996, now U.S. Pat. No. 5,787,022, which is a division of U.S. patent application Ser. No. 08/430,444, filed Apr. 28, 1995, now U.S. Pat. No. 5,605,198, issued Feb. 25, 1997, which is a continuation-in-part of U.S. patent application Ser. No. 08/353,453, filed Dec. 9, 1994, now U.S. Pat. No. 5,590,729, issued Jan. 7, 1997, and a continuation-in-part of U.S. patent application Ser. No. 08/164,481, filed Dec. 9, 1993, now U.S. Pat. No. 5,435,403, issued Jul. 25, 1995.

BACKGROUND OF THE INVENTION

1. Field of the Invention

The present invention relates generally to placement of cutting elements on a rotary drag bit for use in drilling subterranean formations and, more specifically, to placement on various regions of the bit body of certain types of superabrasive cutting elements specifically engineered to better accommodate certain types of loading experienced in those regions during drilling.

2. State of the Art

Superabrasive, also termed "superhard", materials such as diamond and cubic boron nitride are employed in cutting elements for many commercial applications. One major industrial application where synthetic diamond structures are commonly employed is in cutting elements on drill bits for oil and gas drilling.

Polycrystalline diamond compact cutting elements, commonly known as PDC's, have been commercially available in planar geometries for over 20 years. PDC's may be self-supporting or may comprise a substantially planar diamond table bonded during formation to a supporting substrate. A diamond table/substrate cutting element structure is formed by stacking into a cell layers of fine diamond crystals (100 microns or less) and metal catalyst powder, alternating with wafer-like metal substrates of cemented tungsten carbide or other suitable materials. In some cases, the catalyst material may be incorporated in the substrate in addition to or in lieu of using a powder catalyst intermixed with the diamond crystals. A loaded receptacle is subsequently placed in an ultrahigh temperature (typically 1450–1600° C.), ultrahigh pressure (typically 50–70 kilobar) diamond press, wherein the diamond crystals, stimulated by the catalytic effect of the metal power, bond to each other and to the substrate material. The spaces in the diamond table between the diamond to diamond bonds are filled with residual metal catalysis. A so-called thermally stable PDC product (commonly termed a "TSP") may be formed by leaching out the metal in the diamond table. Alternatively, silicon, which possesses a coefficient of thermal expansion similar to that of diamond, may be used to bond diamond particles to produce an Si-bonded TSP. TSP's are capable of enduring higher temperatures (on the order of 1200° C.) without degradation in comparison to normal PDC's, which experience thermal degradation upon exposure to temperatures of about 750–800° C.

While PDC and TSP cutting elements employed in rotary drag bits for earth boring have achieved major advances in obtainable rate of penetration (ROP) while drilling and in greatly expanding the types of formations suitable for drilling with diamond bits at economically viable cost, the diamond table/substrate configurations of state of the art PDC planar cutting elements leave something to be desired from a stressrelated structural standpoint due to internal residual stresses induced during fabrication. TSP's, which are generally formed as free-standing structures without a substrate or backing, have fewer manufacturing-induced internal stresses, but the internal structure of certain types of TSP's renders them somewhat brittle, and certain techniques by which they may be affixed to a bit crown may induce stresses.

To elaborate on the foregoing, one undesirable aspect of PDC cutting elements which contributes to their less than optimum performance under loading during drilling involves the residual stresses in the diamond table and in the supporting WC substrate, which stresses are induced during the manufacturing process as the cutting elements are returned to ambient temperature and pressure. While the diamond table is generally in compression and the substrate in tension, state of the art planar cutting elements exhibit a continuous area of undesirable residual tensile stress at or near the diamond and WC interface at the periphery of the cutting element and another ring of tensile stress on the cutting face just radially inward of its periphery.

As a result of the diamond table/substrate interface-area tensile stresses, PDC cutting elements are susceptible to spalling and delamination of the diamond table from the substrate due to loading from Normal, or axial, forces generated along the bit axis by the drill string, which is the dominant loading at the center (cone) and nose of a typical rotary drag bit.

As a result of the cutting face residual tensile stresses in the diamond table, bending attributable to the tangential or torsional loading of the cutting element by the formation primarily attributable to bit rotation may cause fracture of the diamond table. It is believed that such degradation of the cutting element is due at least in part to lack of sufficient stiffness of the cutting element so that, when encountering the formation, the diamond table actually flexes due to lack of sufficient rigidity or stiffness. As diamond has an extremely low strain rate to failure, only a small amount of flex can initiate fracture. This type of loading is generally dominant at the flank and shoulder of a typical rotary drag bit.

TSP cutting elements, as noted above, suffer fewer undesirable residual stresses as a result of the fabrication process since they are not bonded to a substrate, but the leached types of such cutting elements in particular are less impact-resistant than PDC's due to the porous nature of the diamond table. Moreover, it has been known in the art to bond TSP's to supporting substrates or carrier elements, such as by brazing, which process can and does induce stresses in the diamond table and along the diamond/carrier interface. Further, it is known to coat leached TSP's with single- and multi-layer metal coatings (as taught, respectively, by U.S. Pat. Nos. 4,943,488 and 5,049,164) so that they might be metallurgically bonded to a bit matrix during the furnacing operation rather than merely mechanically retained in the matrix, offering greater security with greater exposure of diamond volume for cutting purposes. Such coating and bonding to the bit matrix also can and does induce stress in the diamond. Thus, even with TSP cutting elements, residual stresses present in the diamond volume may weaken the cutting element against drilling-induced stresses.

Analysis of cutting elements from used bits shows that about eighty-five percent (85%) of PDC cutting elements fail in fracture due to operational loads in combination with residual manufacturing process-induced stresses. Thus, a serious problem exists with state-of-the-art planar PDC cutting elements.

It has also been ascertained, both empirically and through finite element analysis (FEA) numerical modelling techniques, that stress-related failure of PDC and TSP cutting elements occurs nonuniformly over the face of any given bit, even when all of the cutting elements on the bit are identical and similarly back-raked and side-raked. It has been demonstrated that differences in bit cross-sectional profile, rock type, rock stresses, and filtration, as well as other parameters relating to cutting element placement and orientation, may each contribute to some extent to the state and magnitude of stresses experienced by an individual cutting element. Thus, in many instances, loading of cutting elements in closely adjacent positions on the bit body is vastly different in both type and degree.

While differing bit profiles and radial location of a given cutting element result in different magnitudes, types and locations of high-stress areas on a bit crown (all other conditions being equal), such high-stress areas and their characteristics can be predicted with reasonable certainty using FEA.

In general, it has been discovered by the inventors that high stresses attributable to high tangential or torsional loading are experienced on cutting elements located at the bit flank and shoulder, which may be defined as the transitional regions between the bit nose and the bit gage. With some bit profiles, the greatest tangential loading may be on the shoulder immediately below the gage (given a normal bit orientation of a downwardly-facing bit face) as the profile turns radially inwardly on the bit face. Other profiles may concentrate the loading on the flank farther below and radially inward of the gage. It appears, in any case, that the highest tangential or torsional loading occurs on the radially outermost side of the bit body profile.

In the same vein, it has been discovered that higher combined axial (Normal) and tangential loading with substantial axial and tangential components, dominated by axial loading, is experienced at the center and nose of the bit face.

Therefore, cutting elements located in the different regions of the bit face experience vastly different loading. The effects of the loading have been accommodated in state of the art bits by variations in back rake of the cutting elements and in redundancy in certain critical regions. However, as the real or "effective" back rake of a cutter may be, and usually is, different from the fixed back rake with respect to the bit axis, obtaining a beneficial back rake for damage control purposes may result in poor cutting action.

Each cutting element or "cutter" located at a given radius on a bit crown will traverse through a helical path upon each revolution of the bit. The geometry (pitch) of the helical path is determined by the rate of penetration of the bit (ROP) and the rotational speed of the bit. Mathematically, it can be shown that the helical angle relative to the horizontal (or a plane Normal to the bit axis) decreases from the center of the bit to the shoulder for a given ROP and rotary speed. Essentially, the innermost 1½" to 2" of bit face radius centered about the bit axis experiences the greatest change in helix angle, going from near 90° at the center to about 7° at the 2" radius. The change in helix angle from that location to the bit gage is relatively small. This phenomenon of variance in "effective rake" of a cutter with radial location, bit rotational speed and ROP is known in the art, and a more detailed discussion thereof may be found in U.S. Pat. No. 5,377,773, assigned to the assignee of the present invention and incorporated herein by this reference.

Planar state of the art PDC's (and planar TSP's) are set at a given back rake (usually negative) on the bit face to enhance their ability to withstand axial loading, which is dominated by the weight on bit (WOB). By comparing the effective back rake of a cutter (taking into account the helix angle for a given ROP and rotary bit speed), it is easy to see that cutters in the innermost 0" to 2" of radius from the bit axis or centerline have effective back rakes which are very high in comparison to those in other positions on the bit crown.

High back rakes have been shown to have the ability to carry much higher relative axial loads. It is known that the highest individual loading on cutters occurs from the center to the nose of the bit. This is a result of the substantial or even dominant axial component of the combined axial and tangential loading on a cutter in that region, and in the single cutter coverage for a given radius necessitated by the limited bit face area at and surrounding the center of the bit. Current PDC bit design thus dictates that cutter back rake be varied from high negative back rakes in the center to less negative back rakes toward the flank and shoulder. The higher center cutter negative back rakes provide more protection to the cutter against fracture damage by axial loading, the higher negative back rake beneficially orienting the tensile-stressed region at the diamond table/WC substrate interface against shear failure. Particularly high back rakes are further necessitated by the aforementioned high helix angle which produces a relatively more positive back rake, thus requiring more negative back rake to achieve a "net" negative back rake to avoid cutter damage.

While the higher effective negative back rake permits the use of conventional, state of the art planar PDC cutters in the center region, such higher effective back rakes reduce the aggressiveness of the cutter. This drawback becomes more critical to bit performance with distance from the center of the bit, high negative back rakes at the flank and shoulder to accommodate tangential or torsional-dominated loading on the cutters being very disadvantageous given the large volume of formation material to be cut at the larger diameters of those regions. Further, in bits with high design ROP or to which high WOB is applied, axial loads in the center of the bit may exceed the load-bearing capacity of standard cutters, even with high negative back rake.

Several approaches have been taken to cutting element design in order to accommodate operational stresses. For purposes of this application, such cutting elements will be referred to as "engineered" cutting elements. For example, U.S. patent application Ser. No. 08/164,481, filed Dec. 9, 1993, now U.S. Pat. No. 5,435,403 and assigned to the assignee of the present invention, discloses cutting elements engineered to better withstand bending stresses (resulting from tangential or torsional bit loading) by employing a transversely-extending, thickened portion of the superabrasive material table, or another transversely-extending reinforcing element proximate the interface between the superabrasive table and the supporting tungsten carbide (WC) substrate. This design, providing a "bar" of additional superabrasive material thickness, also offers more superabrasive volume for better durability against excessive wear. Also disclosed are preferred orientations and groupings of such cutting elements for maximum cutting effect, wear-resistance and stress-resistance.

U.S. patent application Ser. No. 08/353,453, filed Dec. 9, 1994 and also assigned to the assignee of the present invention, discloses further structural improvements to accommodate bending stresses on cutting elements, such as a rearwardly-extending strut of superabrasive material oriented transversely with respect to the superabrasive material table of a cutting element.

The disclosure of each of the referenced '481 and '453 applications is incorporated herein by this reference.

A so-called "sawtooth" planar PDC cutting element, developed by General Electric and having a series of concentric, planar or sawtooth cross-section rings at the PDC diamond table WC substrate interface has been demonstrated to withstand higher axial loading via reduction and redistribution of diamond table and table/substrate interface tensile stresses. This results in a strengthened cutting element in both tangential and Normal (axial) loading directions, but is most valuable in preventing damage from axial loading of the bit by providing a non-planar diamond table/substrate interface. The symmetrical structure of the diamond table/substrate interface is also advantageous, as not requiring a specific, preferential rotational orientation of a sawtooth cutting element on the bit face, unlike some other cutting element designs which employ parallel interface ridges extending across the cutting element.

Yet another recent cutting element engineering improvement is disclosed in U.S. patent application Ser. No. 08/039,858, filed Mar. 30, 1993 and assigned to the assignee of the present invention, and incorporated herein by this reference. This application discloses and claims use of a tapered or flared substrate which enhances the robustness of the cutting element in certain high compressive strength formations by providing superior support to the diamond table against loading experienced when the bit is first employed, particularly before normal wear flats form on the cutting elements. The tapered or flared substrate provides an effectively stiffer backing to the diamond table against tangential loading and an enlarged surface area adjacent the cutting edge to accommodate a portion of the Normal or axial loading.

Still another notable improvement in cutting element design is disclosed and claimed in U.S. patent application Ser. No. 07/893,704, filed Jun. 5, 1992, assigned to the assignee of the present invention, and incorporated herein by this reference. This application discloses and claims the use of multiple chamfers at the periphery of a PDC cutting face, which geometry enhances the resistance of the cutting element to impactinduced fracture. Moreover, if the angle of the outermost chamfer is substantially matched to the effective back rake of the cutting element, a bearing surface is provided to reduce the loading per unit area on the side of the diamond table, thus enhancing resistance to axial or Normal forces experienced by the cutting element.

Even with the aforementioned advances in cutter design, there has been little or no recognition in the art prior to the present invention that bit profile design and cutter design, placement and orientation on a bit crown should be approached from a "global" standpoint for optimum results of ROP and robust structural characteristics. Specifically, the art has not recognized the importance of understanding each cutter on a bit crown as a load-bearing structure, taking into account the residual stresses present in the cutter, mechanical loading (axial, tangential and the resultant combined axial/tangential loading), thermal loading during the drilling operation due to cutting friction and limitations or constraints in heat transfer from the diamond table, wear or abrasion of the cutters, available material choices, and bit profile and cutter geometry as well as rock strength and other formation characteristics.

Given the recognition of the importance of these factors by the inventors and the ability to design and select cutter type, placement and orientation, it has been realized by the inventors that, while it might be possible to employ engineered cutting elements of only one type over the entire face of a bit, the accommodation of the cutting element design to the complex and different loads applied on different regions of the bit face would not be optimized.

It has also been ascertained by the inventors that selective placement of specific types of engineered cutting elements on rotary drag bits in certain regions, in combination with conventional cutting elements, may result in more robust bits with a longer effective life and higher potential ROP, the engineered cutting elements accommodating the high- or complex-stress loading and complementing the conventional cutting elements. In other words, it is possible, but not preferred, to employ a combination of engineering and conventional cutting elements in accordance with the present invention.

SUMMARY OF THE INVENTION

The present invention comprises a rotary drag bit including a bit body secured to a bit shank, the bit body having a bit face defining a profile extending from the centerline to a gage at the radial periphery of the bit body. In an exemplary bit design, a transitional flank region extends from the shoulder below the gage to the nose, from which the bit face extends radially inwardly to the centerline or longitudinal axis of the bit. Engineered cutting elements of one of the types previously described, which are capable of withstanding high tangential or torsional loading, are disposed on the shoulder and flank regions to address the bottom hole rock strength given the particular bit profile and drilling environment. Other differently-engineered cutting elements may be disposed from the center to the nose on the bit face to accommodate the higher combined axial and tangential loading in that region.

It should be understood that changes in the bit profile and in the environment in which the bit is to be employed will affect the stress patterns encountered on the different regions of the bit face, and thus the above-described exemplary placement of different types of engineered cutting elements must be viewed as just that, and not fixed, invariable design criteria.

In certain transitional areas such as at the nose, several types of engineered cutters may be employed at the same or closely adjacent radii on the bit face, or so as to be in partial or full overlapping relationships as to cutter path (looking as the cutters travel rotationally), so as to accommodate the complex and perhaps somewhat unpredictable loading experienced by the bit and cutters during real-world drilling operations. Thus, it is not preferred to employ an abrupt transition at a given radius on the bit face between a first and a second type of engineered cutting element, which approach may very well result in catastrophic cutter failure and "ring out" at that radius wherein the formation remains totally uncut and acts as a bearing surface, retarding if not precluding further penetration. Rather, two different types of circumferentially-spaced cutters may be placed on the exact same radius, or on closely adjacent radii in partial lateral overlapping relationship of their rotational cutting paths Stated another way, the present invention encompasses and includes a rotary drag bit having a design or given profile and cutting elements placed on the bit crown engineered to accommodate anticipated mechanical loading at a given cutting element location over the various regions of the bit face, including in transitional areas between the primary regions. Load vectors at specific cutting element radii may be calculated and then appropriately-engineered cutting elements placed and oriented.

Carried further, the invention also contemplates consideration of formation rock type, rock stresses, filtration and filtration gradients versus design depth of cut in permeable rocks, as well as cutting clement wear and thermal loading, in selection, placement, orientation and number of cutting elements of a plurality of types on the bit crown. Generally, thermal loading with associated high wear rates is experienced on the shoulder (in part due to less effective hydraulics and cooling), as well as impacts. In the degenerate case, every cutting element would be designed or selected to accommodate specific loading.

With appropriate cutting clement design, negative back rake may be significantly reduced if not eliminated in certain regions to produce a more aggressive bit with a higher ROP and, in some instances, without the undue cutting element redundancy employed in state-of-the-art bits, resulting in a higher-performance bit. Stated another way, large, negative, nonaggressive back rakes may be eliminated without risk to the bit.

The invention also contemplates and includes a method of designing bits to enhance performance and lower cost.

DETAILED DESCRIPTION OF THE INVENTION

Figure 1:
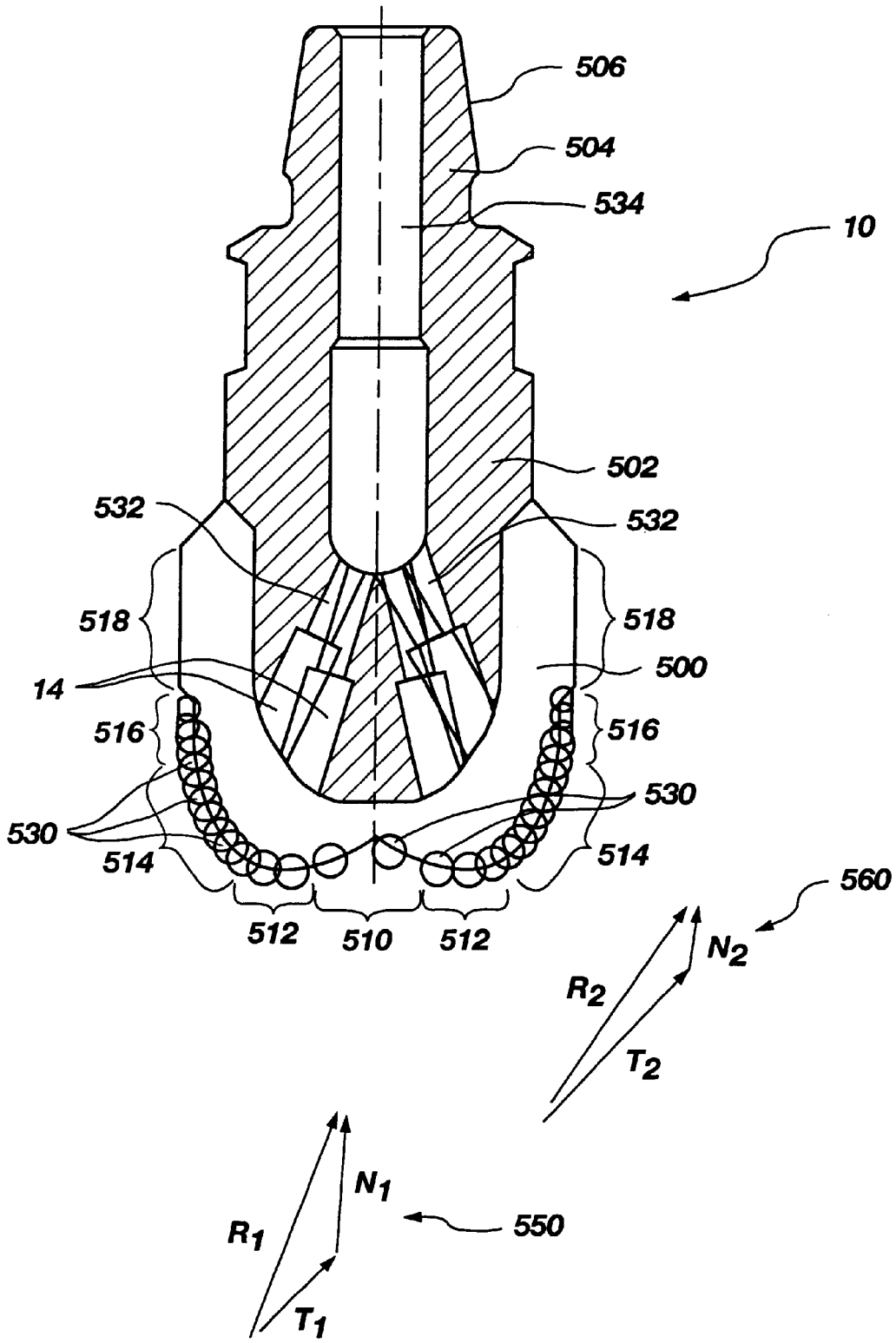
FIG. 1 is a side cross-sectional elevation of a five-bladed drill bit in accordance with the present invention, designating certain regions on the profile and showing relative axial, tangential and resultant loading at the center and shoulder of the bit.

FIG. 1 of the drawings depicts a rotary drag bit 10 in side sectional elevation, oriented as during a normal drilling operation. Bit 10 is a matrix-type bit formed as a mass 500 of powdered WC infiltrated with a hardenable liquid binder on steel blank 502, which is shown here as a single piece of shank 504 having an area 506 to be threaded for attachment to a drill string. Various regions on the bit crown defined by matrix mass 500 are also identified: center or cone 510 nose 512, flank 514, shoulder 516, and gage 518. All of these regions are circular or annular in configuration, and there is not necessarily a clear break point or line between regions. Rather, each region transitions more or less gradually into another in most bits. On bits with other profiles, differing regions as enumerated above may be enlarged or diminished, or substantially eliminated as a practical matter.

Cutting elements on bit 10 are generally designated by reference numeral 530. Internal passages 532 lead from the center 534 of hollow shank 504 to the face 12 (FIG. 2) of the bit at apertures 14, wherein nozzles (not shown) may be placed to direct drilling fluid. Bit 10 may also be a steel-bodied bit or of other construction known or contemplated in the art, the present invention not being dependent on the type of bit construction.

Also shown in FIG. 1 are two load vector diagrams 550 and 560 representative of the types and relative magnitudes of loads experienced by bit 10 during drilling. Diagram 550 exhibits the axial or Normal load ($N_1$)- dominated complex resultant loading $R_1$, the tangential loading $T_1$ produced by bit rotation being relatively small or less dominant in comparison to the loading produced by WOB in the axial direction. In contrast, diagram 560 shows the very large tangential loading $T_2$ in comparison to the axial or Normal loading $N_2$, providing a vastly different resultant load $R_2$. Between the two extremes, each radial location on the bit face will, for a given WOB, rotational speed, and profile, experience a different resultant load R. Of course, as noted above, thermal loading, cutter wear rates, rock strength and type as well as filtration, filtration gradients and design depth of cut (and perhaps other, still unknown or unrecognized parameters) will also affect the stresses experienced by each cutting element.

Figure 2:
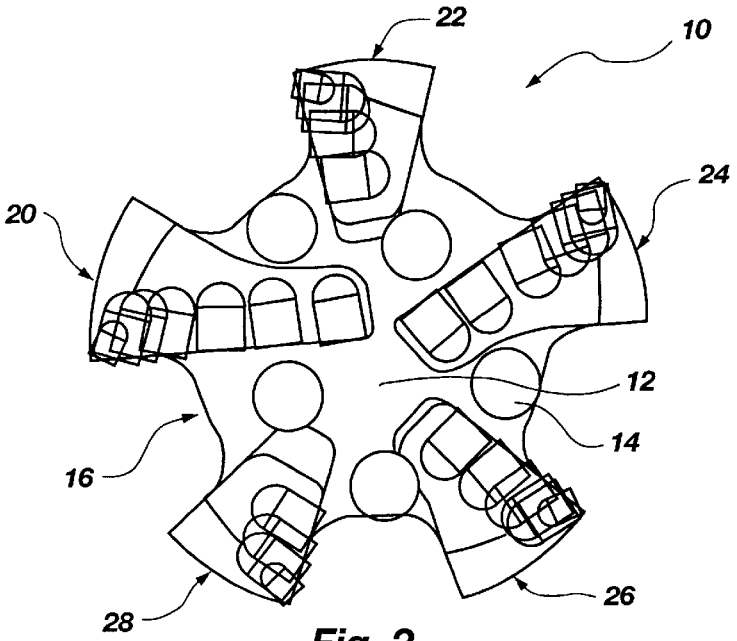
FIG. 2 is a bottom elevation of the five-bladed drill bit of FIG. 1 in accordance with the present invention.

FIG. 2 of the drawings depicts the five-bladed drill bit 10 of FIG. 1 from the bottom, as it would appear to one looking upward from the subterranean formation being drilled. Bit face 12 includes apertures 14 therein, in each of which a nozzle (not shown) as known in the art would be placed, to direct drilling fluid to cool and clean the cutting elements and remove formation cuttings and other debris from the face of the bit and toward the surface via junk slots 16. Five blades, 20, 22, 24, 26 and 28, extend from the face of bit 10.

Figure 6:
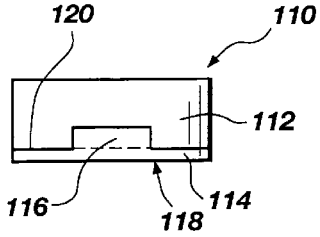
FIGS. 6 through 14 depict several variations of a first embodiment of an engineered cutting element suitable for disposition on a bit body in a high tangential-stress region.
Figure 7:
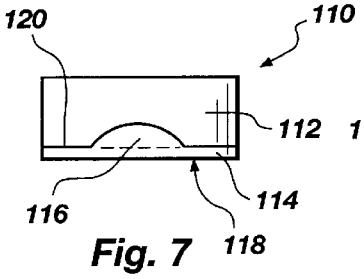
Figure 8:
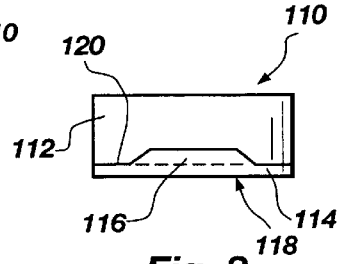
Figure 9:
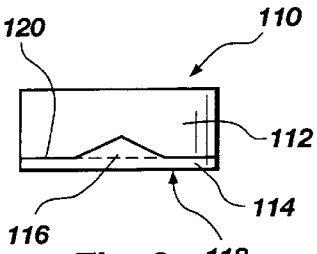
Figure 10:
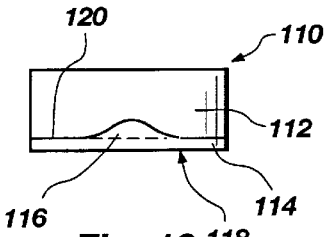
Figure 11:
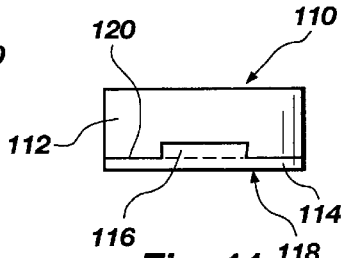
Figure 21:
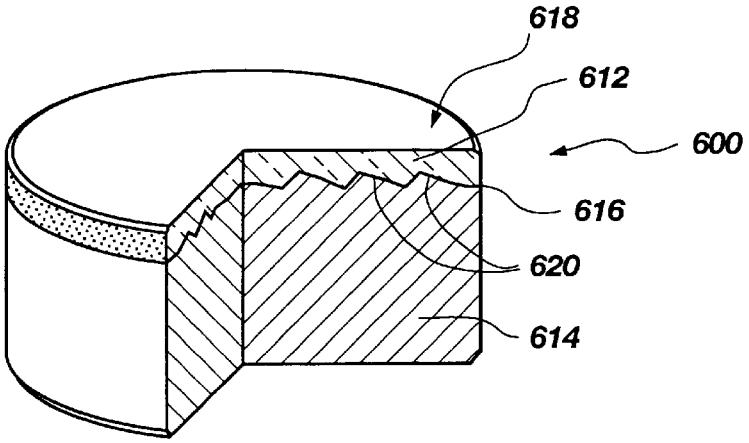
FIG. 21 depicts a perspective, partial sectional elevation of a cutting element suitable for disposition on a bit body in a high axial or combined axial/tangential stress region.

FIGS. 2A through 2E each depict one of the bit blades 20, 22, 24, 26 and 28 from a side view. Each blade carries one or more of several types of cutting elements thereon. First is a circular PDC, designated by reference numerals 30, engineered to withstand high axial and combined axial and tangential loading experienced at the center and nose of the bit profile. An example of such a cutting element is shown in FIG. 21. The second is a smaller PDC with a flat on its gage side, which is used as a so-called "gage trimmer," and designated by reference numerals 32. Cutting elements 32 may be conventional, but are preferably engineered to withstand high tangential loading. The third type of cutting element is a cutting element 34 of the type described below and depicted in FIGS. 6 though 20, or of any other type known in or contemplated by the art engineered to withstand the high tangential loading experienced at the flank and shoulder of the bit profile. As can readily be seen, the engineered cutting elements 34 are placed above and radially outwardly from the lowermost point 40 on each blade.

A series of such engineered cutting elements 34 extends downwardly on the blade profile to a gage trimmer 32, immediately above gage pad 36 on the radially outer surface of each blade. Gage pads 36 may be provided with wear elements such as WC inserts or even PDC inserts (not shown) to prevent premature wear (and thus an undergage borehole) and to provide a bearing surface for the bit to ride against the borehole wall. Alternatively, the gage may be provided with engineered cutting elements to withstand high tangential loading and to therefore permit and promote cutting by the gage, a potentially valuable feature for steerable bits employed in directional drilling operations. Radial loading or lateral loading of such cutting elements (as opposed to tangential) may also become a design factor, being similar to axial or Normal loading near the bit center.

Figure 2A:
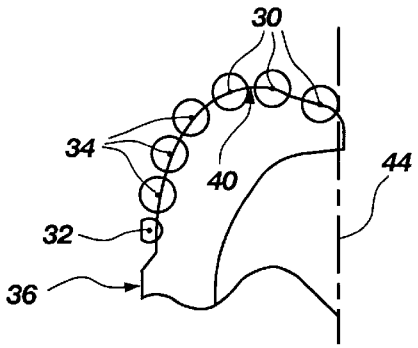
FIGS. 2A through 2E are side elevations of each of the five blades of the bit of FIG. 1, depicting placement of engineered cutting elements thereon.
Figure 2B:
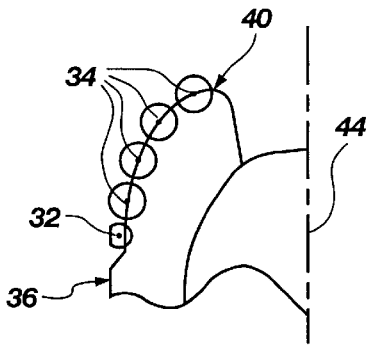
Figure 2C:
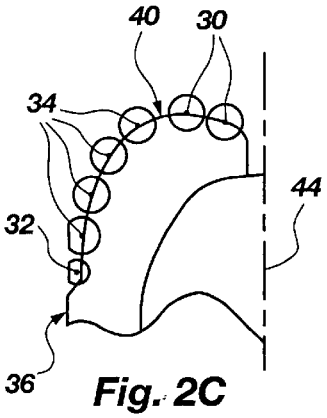
Figure 2D:
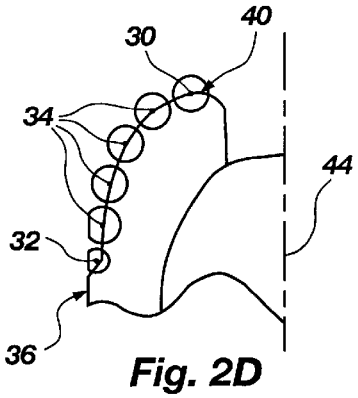
Figure 2E:
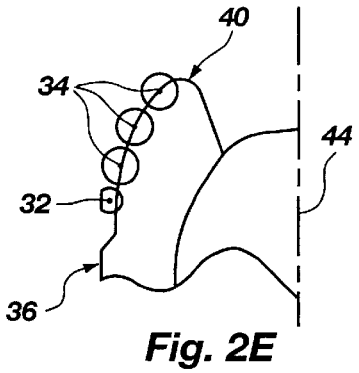

As can be appreciated from even a cursory review of FIGS. 2A through 2E, there is no abrupt transition at one radius between cutting elements 30 and cutting elements 34; rather, the different cutting element types transition across an inter-regional zone from one type to another, the zone containing at least one type of each cutting element. FIGS. 2A, 2B and 2C are particularly illustrative when making reference to cutting element location with respect to the bit centerline 44.

Figure 3:
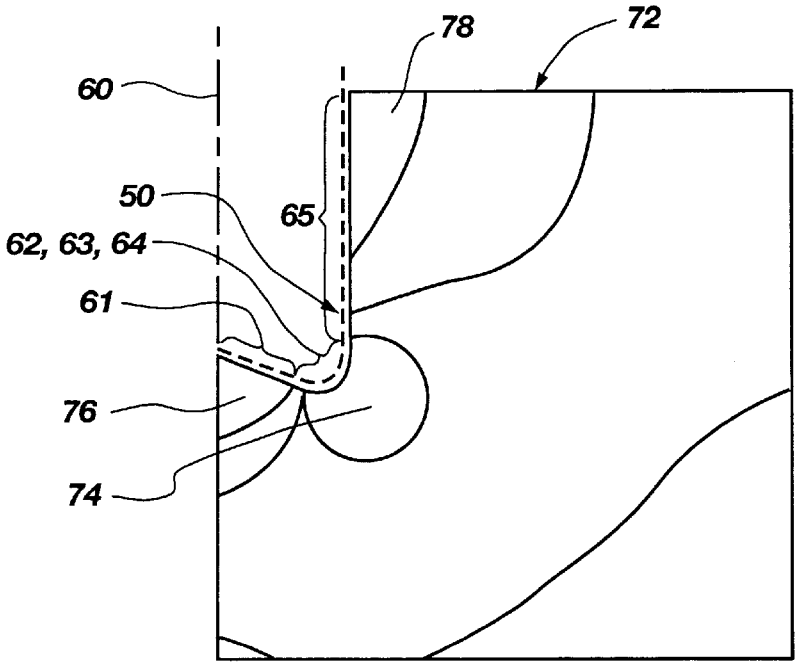
FIGS. 3 through 5 comprise FEA-generated graphic depictions of various strength zones exhibited by rock formations drilled with three different bit profiles, which different zones are indicative of the loading on the adjacent areas on the bit body of each given profile.
Figure 4:
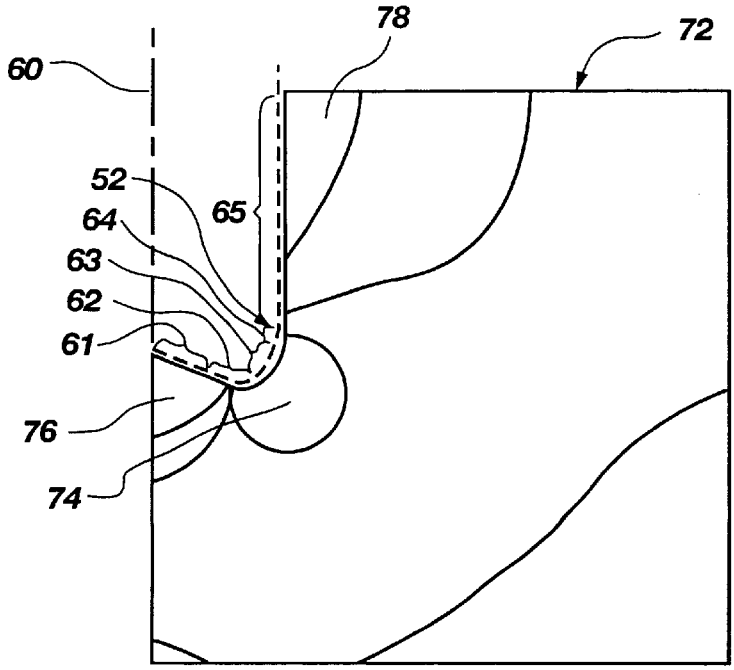
Figure 5:
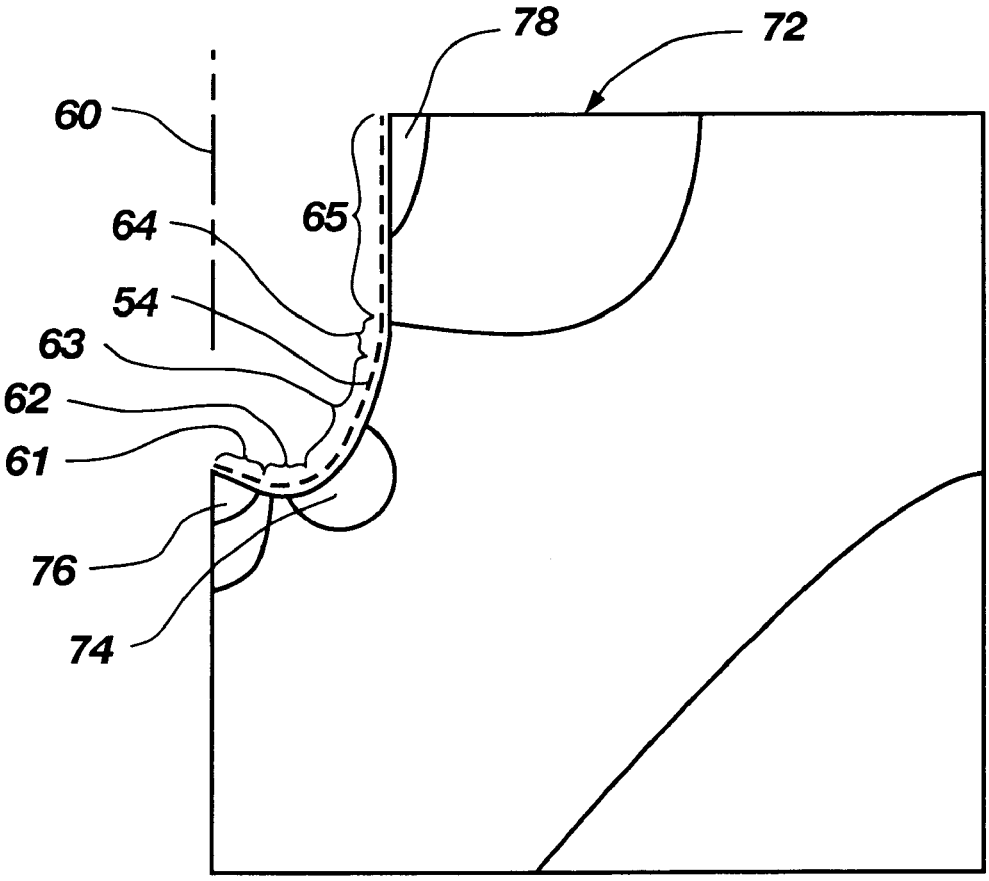

FIGS. 3 through 5 comprise FEA-generated graphic depictions of the variable strengths exhibited by a "sample" formation rock 72 responsive to drilling with bits of profiles 50, 52 and 54, respectively. It will be appreciated that only one-half of a profile is shown for the sake of convenience, the profile terminating in each figure at a centerline 60. Each profile may be generally divided into three to five regions, depending on the profile: the center 61, the nose 62, the flank 63, the shoulder 64, and the gage 65.

As may be observed from each of FIGS. 3 through 5, the highest formation strengths for those particular exemplary bit profiles and drilling environments appear in zones 74 of formation 72, located proximate the flank 63 and shoulder 64, as the case may be. The magnitude of the strength varies with the bit profile selected and 9 with some profiles, the strength in zones 74 may be twice that in other zones. Even in the best case, there is exhibited a high strength concentration in zones 74, which experience high torsional loading during drilling. Conversely, for the profiles illustrated, the lowest strengths are exhibited in zones 76 below the bit centers 61 and noses 62 and in zones 78 adjacent gages 65 and well above flanks 63 and shoulders 64. Zones 76 and 78 are subject to higher combined axial and tangential loading, in contrast to the high tangential or torsional loading experienced in zones 74. Thus, cutting elements engineered to withstand high axial or Normal loading may be used at the centers 61 and noses 62 of the bits. Cutting elements engineered to withstand high tangential loads may be used at the flanks 63 and shoulders 64. Both types of engineered cutting elements may be oriented with less negative back rake and placed on a bit in lesser numbers than conventionally designed PDC's with a straight diamond table/substrate interface and no reinforcement against bending stresses.

In order to better correlate rock formation strength variation over a given bit profile with the loading experienced by a cutting element on different regions of the bit face, it should be observed that relatively high rock strength at a shoulder or flank region will result in higher tangential or torsional loading on a cutting element (than if a lower rock strength is present) for a given depth of cut, while high relative rock strength at the nose or center of the bit face will result in higher axial loads to indent and cut the rock as desired. Thus, given the in-situ stress state of a formation as penetrated by a given bit profile, accurate and beneficial cutting element selection and placement may be effectuated as rock strength is significant to the stress experienced by a cutting element at any particular location, the cutting element being required to sustain a higher load than that required to fail the rock.

Alternatively and perhaps preferably in some instances, the optimum profile for the target formation may first be selected from an ROP standpoint, and engineered cutting elements selected and placed (or even designed if necessary) to achieve the design performance goal while yielding a robust bit. It should be noted that rock strength can be implied from logging data, but that, to the inventors' knowledge, the stress profile must then be mathematically modelled to "regionalize" the magnitude and direction of the resultant loads on the profile.

Filtration characteristics and probable filtration gradients also contribute to the rock strength of permeable formations. Since such characteristics can be predicted empirically as well as mathematically, they can be employed as an additional contributing factor to the predicted rock strength. In addition, the filtration gradient relative to the design depth of cut of a cutting element may have a large effect on the loading on the cutting element and thus on the net effective stress it experiences, particularly increasing same if the design depth of cut does not extend through the gradient. Accordingly, cutting element placement relative to the profile may also be adjusted in the design process.

Thermal loading of a cutting element may well be an important parameter to consider in cutting element and bit design but has not been particularly emphasized in the art. However, the inventors herein have come to appreciate that cutting elements on certain regions on the profile may be much more highly stressed thermally than those on other regions. Shoulder locations appear to exhibit such characteristics which may be aggravated when using a steerable bottomhole assembly due to the side forces required. As bit hydraulics in those same regions are generally not optimum, the cutting elements themselves may be provided with internal hydraulic cooling or enhanced heat transfer characteristics to prevent thermally-induced degradation of the superabrasive table. It is believed that reduction in thermally-induced cutter degradation will manifest itself as an increase in the apparent wear-resistance of a cutting element. In other words, the apparent wear rate due to abrasion and erosion should be markedly reduced with better thermal modulation of a cutting element. In addition, cutting element design and placement effected to minimize and stabilize cutting element temperatures will modify the interior stress state of the cutting element, thus beneficially affecting the net effective stress experienced by the cutting element.

Selecting cutting elements with wear characteristics appropriate for a particular location is also an approach which will enhance bit efficiency, effectiveness and longevity. If one considers the wear characteristics of different superabrasive materials as well as the superabrasive volume likely to be required on a given radius, optimum material selection and placement thereof can be made. Cutting element modification to provide greater wear resistance can also be effectuated. Since fast wear creates a wear flat more rapidly, which in turn affects (increases) the load on a cutting element required to cut the formation due to the larger indention area, selection of appropriate cutting element materials, geometries orientations and placements is important.

The inherent, residual stresses their magnitudes, location and continuous or discontinuous nature, may also greatly affect the suitability of a particular cutting element for a particular application as far as placement on the bit is concerned. Since the interval stress states of cutting elements for different geometries can be mathematically modelled using FEA techniques, such analyses may be a highly beneficial part of the cutting element selection, orientation and placement process.

In order to effectuate optimum placement of engineered cutting elements, the drilling environment with as many parameters as possible should be simulated, mathematically via FEA, or otherwise for a given design profile. Thus, known formation lithology including unstressed rock strength, permeability and other parameters obtainable from logging and seismic studies, as well as design rotational speed, WOB and design ROP, thermal loading on cutters cutter wear rates, design depth of cut and drilling fluid-related characteristics such as filtration rates and gradients may be employed to optimize cutter selection and placement. In extreme cases, such modelling may dictate that another bit profile altogether be employed for a more beneficial or economically viable result.

Referring now to FIGS. 6 through 14 of the drawings, a plurality of cutting elements 110 of alternative geometries is depicted as viewed from above as the cutting elements 110 would be mounted on the face of drill bit 10. Each cutting element 110 comprises a substrate or backing 112 having secured thereto a substantially planar table 114 of a superhard material such as a polycrystalline diamond compact (PDC), a thermally stable product (TSP), a cubic boron nitride compact (CBN), a diamond film either deposited (as by chemical vapor or plasma deposition, for example) directly on the substrate 112 or on one of the other aforementioned superhard materials, or any other superhard material known in the art.

Figure 12:
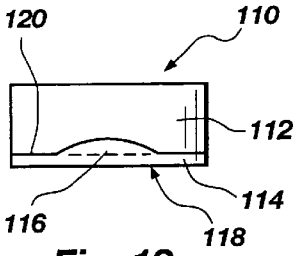

Superhard tables 114 comprise two portions, a first center portion 116 of enhanced thickness, as measured from the cutting face 118 of the cutting element towards substrate 112, and peripheral flank or skirt portions 120 of relatively lesser thickness flanking the center portion 116 on both sides. The substrate 112 may be sintered tungsten carbide or other material or combination of materials as known in the art, and the cutting elements 110 may be fabricated employing the technique previously described in the background of the invention and state of the art, or any other suitable process known in the art. A most preferred embodiment of the cutting element 110 of the present invention is shown in FIG. 12, with portion 116 having radiused edges.

As depicted in FIGS. 6 through 14, center portions 116 (also termed reinforcing-portions) of superhard material tables 114 are of substantially regular shapes and extend linearly across the cutting faces 118 of cutting elements 110. If cutting element 110 is a circular cutting element, center portion 116 would normally extend diametrically across the surface of the cutting element 110.

A major feature of the linearly extending center portion 116 is that the center portion 116 may be oriented when mounted on the bit so as to be substantially perpendicular to the profile of the bit face. With such an orientation, as the cutting element 110 wears, the wear, as well as the majority of the loading due to cutting element overlap, will be primarily sustained through center portion 116 so as to maximize the use of the additional material in the thicker portion of the superhard material table. Further, as the cutting element 110 of the present invention is designed to be stiffer than the prior state of the art cutting element, the thicker portion 116 of the superhard material table 114 should be properly oriented with respect to the impact and bending forces sustained by the cutting element as its cutting face 118 engages the formation, so that the thicker or "reinforced" portion 116 performs as a column or a bar in resisting the bending loads applied at the outermost edge of the cutting element at the point of engagement with the formation. Also, the presence of portion 116 increases the compressive stresses in the superhard material table 114 and lowers the tensile stresses in substrate 112. The increased diamond volume in portion 1116 also provides additional wear resistance where desirable at the center or other design location of the cutting element. The laterally overlapping radial placement of cutting elements on the bit profile eliminates the need for a thicker diamond table across the lateral extent of each cutting element, reduces the indention area for each cutting element into the formation, and thus desirably focuses loading on that region of the cutting element best able to withstand it.

Figure 15A:
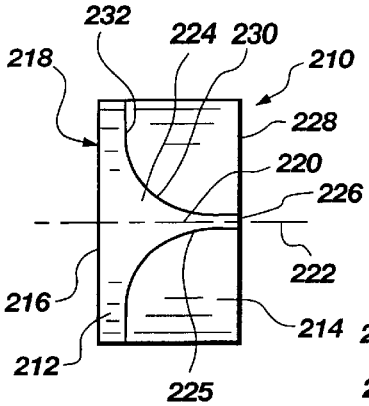
FIGS. 15A, 15B and 16 through 20 depict several variations of a second embodiment of an engineered cutting element suitable for disposition on a bit body in a high tangential-stress region.
Figure 15B:
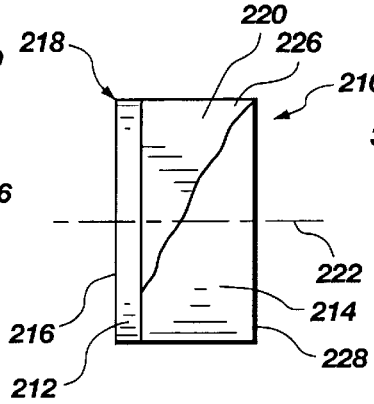

FIGS. 15A and 15B of the drawings depict cutting element 210 including a substantially planar, circular table 212 of superhard material of, for example, PDC, TSP, diamond film or other suitable superhard material such as cubic boron nitride, Table 212 is backed by a supporting substrate 214 of, for example, cemented WC, although other materials have been known and used in the art. Table 212 presents a substantially planar cutting surface 216 having a cutting edge 218, the term "substantially planar" including and encompassing not only a perfectly flat surface or table but also concave, convex, ridged, waved or other surfaces or tables which define a two-dimensional cutting surface surmounted by a cutting edge. Integral elongated strut portion 220 of superhard material projects rearwardly from table 212 to provide enhanced stiffness to table 212 against loads applied at cutting edge 218 substantially normal to the plane of cutting surface 216, the resulting maximum tensile bending stresses lying substantially in the same plane as cutting surface 216. In this variation of the invention, elongated strut portion 220 is configured as a single, diametrically-placed strut. In use, cutting element 210 is rotationally oriented about its axis 222 on the drill bit on which it is mounted so that elongated strut portion 220 is placed directly under the anticipated cutting loads. The strut thus serves to stiffen the superhard table against flexure and thereby reduces the damaging tensile portion of the bending stresses. The orientation of the plane of the strut portion 220 may be substantially perpendicular to the profile of the bit face, or at any other suitable orientation dictated by the location and direction of anticipated loading on the cutting edge 218 of the cutting element 210. As shown in FIG. 15A, strut portion 220 includes a relatively wide base 224 from which it protrudes rearwardly from table 212, tapering to a web 225, terminating at a thin tip 226 at the rear 228 of substrate 214. Optionally, tip 226 may be foreshortened and so not extend completely to the rear 228 of substrate 214. Arcuate strut side surfaces 230 extending from the rear 232 of table 212 reduce the tendency of the diamond table/strut junction to crack under load and provide a broad, smooth surface for substrate 214 to support. Upon cooling of cutting element 210 after fabrication, the differences in coefficient of thermal expansion between the material of substrate 214 and the superhard material of table 212 and strut portion 220 result in relative shrinkage of the substrate material, placing the superhard material in beneficial compression and lowering potentially harmful tensile stresses in the substrate 214.

Figure 18:
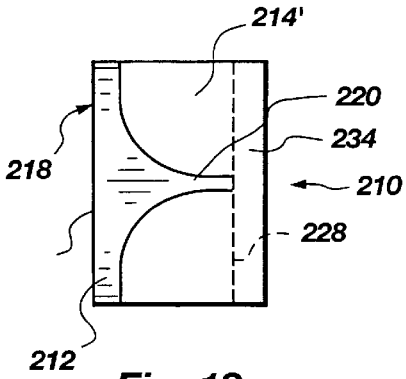

As shown in FIG. 18, cutting element 210 may be formed with a one-piece substrate blank 214' for the sake of convenience when loading the blanks and polycrystalline material into a cell prior to the high-temperature and high-pressure fabrication process. The rear area 234 of blank 214' may then be removed by means known in the art, such as electro-discharge machining (EDM), to achieve the structure of cutting element 210, with elongated strut portion 220 terminating at the rear 228 of substrate 214'. Alternatively, as noted above, rear area 234 may remain in place, covering the tip 226 of strut portion 220.

Figure 16:
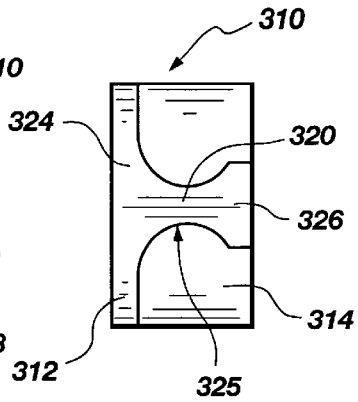

FIG. 16 depicts an alternative cutting element configuration 310, wherein the strut portion 320 extending from superhard table 312 includes a laterally-enlarged tip 326 after narrowing from an enlarged base portion 324 to an intermediate web portion 325. This configuration, by providing enlarged tip 326, may be analogized to an I-beam in its resistance to bending stresses. From the side, cutting element 310 would be indistinguishable from cutting element 210.

Figure 17:
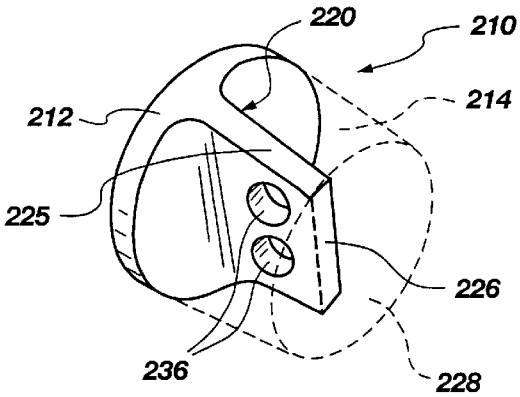

FIG. 17 depicts a cutting element 210 from a rear perspective with substrate 214 stripped away to reveal transverse cavities or even apertures 236 extending through web 225 of strut portion 220. Cavities or apertures 236 enhance bonding between the superhard material and the substrate material and further enhance the compression of the superhard material as the cutting element 210 cools after fabrication.

Figure 19:
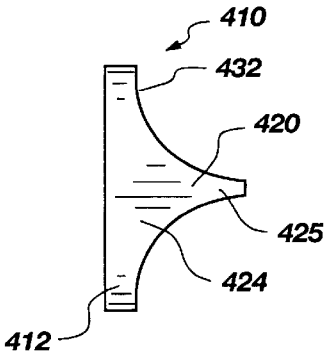

FIG. 19 depicts a diamond table 412 and strut portion 420 configuration similar to that of FIGS. 2A and 2B, forming cutting element 410. Cutting element 410 may comprise a PDC or preferably a TSP which is furnaced or otherwise directly secured to a bit face or supporting structure thereon, without the use of a substrate 214. It may be preferred to coat cutting element 410, and specifically the rear 432 of diamond table 412 as well as the side surfaces of base 424 and web 425 with a single- or multi-layer metal coating in accordance with the teachings of U.S. Pat. No. 5,030,276 or U.S. Pat. No. 5,049,164, each of which is hereby incorporated herein by this reference, to facilitate a chemical bond between the diamond material and the WC matrix of the drill bit or between the diamond material and a carrier structure secured to the drill bit.

Figure 20:
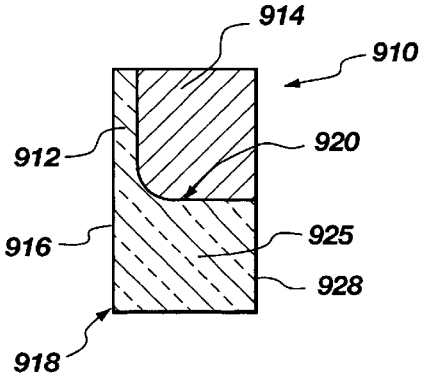

FIG. 20 depicts a cutting element 910 having a substrate 914 and diamond or other superhard table 912 extending into a strut portion 920 which is defined by a web 925 extending only partially transversely across cutting element 910, from table 912 to the rear 928 of substrate 914. Such a partial strut, if oriented properly with cutting loads applied at the lower left-hand cutting edge 918 (as shown) of the cutting face 916, will provide useful enhanced stiffness to table 912.

FIG. 21 is a perspective, partial sectional view of the previously-referenced sawtooth cutter 600. PDC diamond table 612 and WC substrate 614 meet at an interface comprising a concentric series of rings having flat-sided or sawtooth profiles when shown in section. Such a design reduces and redistributes tensile stresses from regions 616 and 618 on the cutting elements and toward interior areas 620.

It should also be noted that the aforementioned '453 patent application discloses a variety of cutting element structures which enhance heat transfer from the diamond table, and which thus may have utility in the shoulder and flank regions of a bit. It is contemplated, although not proven, that what is generally accepted as abrasion-induced cutter wear may in fact be thermally-induced cutter degradation, and that enhanced heat transfer performance in cutters may lead to a reduced necessity for the high diamond volumes currently employed in flank and shoulder regions of bits. Similarly, reduction in mechanical failure of cutters may greatly reduce the apparent abrasion-induced cutter wear.

Figure 22:
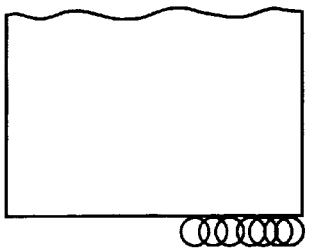
FIGS. 22–24 are schematic side elevations of alternative bit profiles which may be employed with the present invention.
Figure 23:
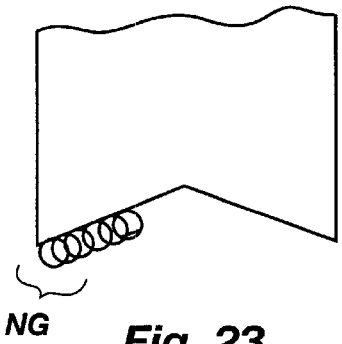

Several common bit profiles have been previously depicted in FIGS. 3–5. However, the invention is not so limited. In fact, bit profiles which have been heretofore viewed as impractical, such as a flat-bottom profile (FIG. 22) and a radical cone profile with no flank (FIG. 23), may become more practical with proper design and selection of cutters. For example, a flat-bottom bit as shown in FIG. 22 is the fastest in terms of'ROP, but to date, cutters have not been able to withstand the loads attendant to such a profile. Similarly, the radical cone profile of FIG. 23, which may be extremely desirable for low-invasion bits used to drill producing formations, would exhibit stresses at the nose/gage region NG which could not be accommodated by conventional cutting elements.

Figure 24:
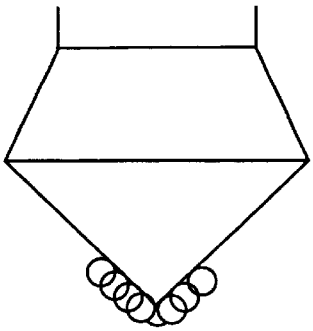

A pointed-center profile as depicted in FIG. 24 may prove practical with the use of engineered cutters. Such a profile would provide enhanced directional stability but it, like the profiles of FIGS. 22 and 23, has been avoided due to the loading constraints or limitations imposed by conventional cutting elements.

It is also contemplated that the present invention has utility with core bits, the term "drill bits" as used herein including same. Core bits may, in fact, benefit even more from the present invention than standard drill bits, due to the presence of inner and outer gages with attendant stress risers, and the size and configuration of the bit face necessitated by the coring operation. In addition, core bits may also benefit to a great extent from a transitional mix of a plurality of cutter types in certain areas. The transition in a core bit from high axial loading to high tangential loading may be quite sudden, and the mixing of cutter types in transition regions is contemplated to accommodate variations between design and real-world loading phenomena.

In addition, it is also contemplated that the apparatus of the present invention as well as the design methodology has great utility with bi-center and eccentric bits used for drilling larger bores below a constriction in the borehole. Such bits, due to their nonuniform configuration, present even more complex stress patterns than a conventional bit.

Figure 25:
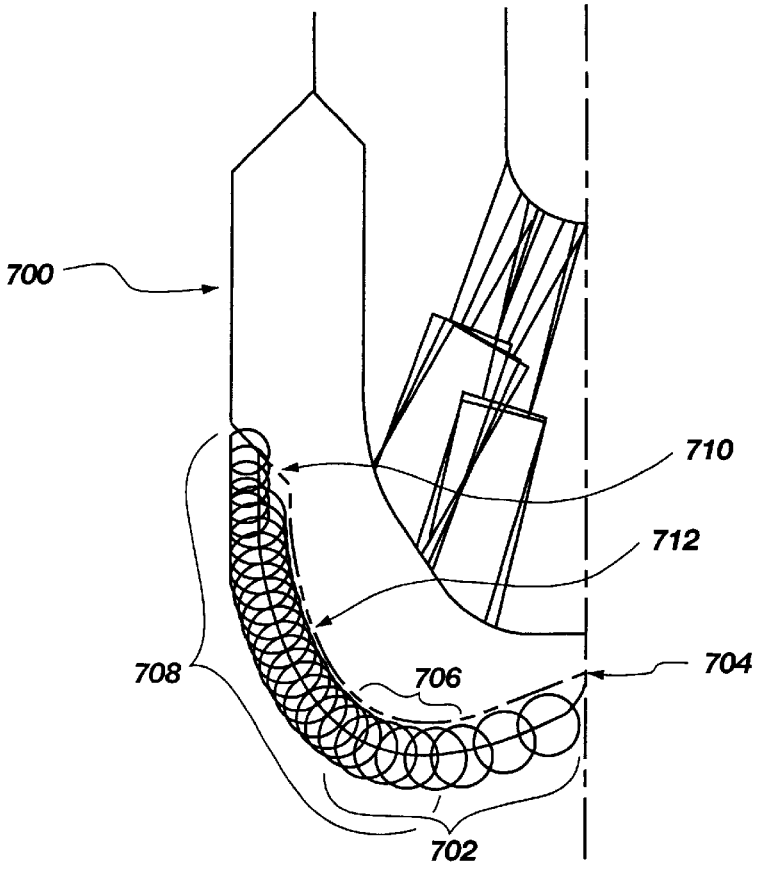
FIG. 25 schematically depicts the profile of a drill bit wherein two types of engineered cutting elements are employed over a single region of the bit face.

FIG. 25 depicts one example of transitional cutting element placement in the context of a drill bit, although such an arrangement would have equal utility in the context of a core bit, as mentioned above. One-half of a drill bit 700 is depicted with a plurality of one type of engineered cutting element 702 at adjacent radial positions extending from the bit center 704 to and over the nose region 706, while a plurality of another type of engineered cutting element 708 is placed at adjacent radial positions extending from the shoulder 710, up the flank 712 and over the nose region 706. Thus, cutting elements 702 and 708 are both present on nose region 706. The two types of cutting elements may only partially overlap due to placement at adjacent radial positions, may fully laterally overlap from adjacent radii due to placement of at least one type of each cutting element on the same radius, or may more than fully overlap with a plurality of cutting elements of one type overlapping one or more of the other type over an annular zone or region of radial cutting element positions. It is equally contemplated that conventional cutting elements might be used in combination with engineered cutting elements, particularly at the flank and shoulder where more surface area on the bit face would permit additional cutting elements.

Figure 26:
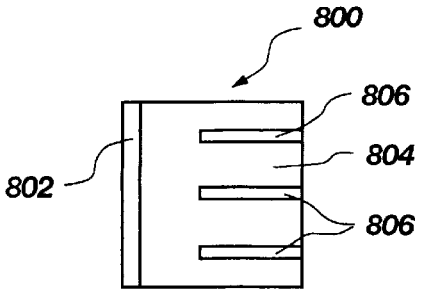
FIG. 26 is a top elevation of another design of engineered cutting element suitable for placement on a bit in a region of high Normal or combined loading.
Figure 26A:
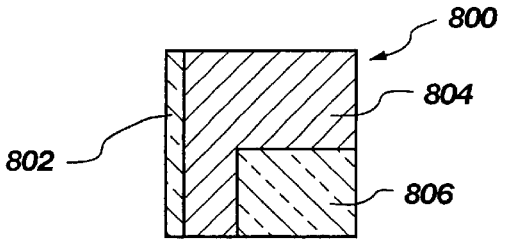
FIG. 26A is a side sectional elevation of that cutting element.

It is further contemplated that additional design changes with respect to cutting element engineering may be made, as depicted in FIGS. 26 and 26A. Cutting element 800 comprises a substantially circular table 802 of superhard material, such as previously described, mounted to a WC or other suitable substrate 804 of cylindrical configuration. Rather than employing a thickened "bar" area at the table 802 or a rearwardly-extending strut, cutting element 800 includes a plurality (three shown here) of substantially parallel, longitudinally-extending blades 806 of superhard material embedded in the substrate 804 and spaced to the rear of table 802. As shown in FIG. 26A, blades 806 do not extend completely through substrate 804. In use blades 806 would normally be mounted substantially perpendicular to the adjacent formation face, presenting a high aspect ratio which will cut well. In addition, the presence of blades 806 breaks up or interrupts the tensile stresses in the WC substrate and provides reinforcement to the cutting element primarily against shearing in axial loading but also against bending in response to tangential loading. Heat transfer from the diamond table through the substrate may also be enhanced. It is possible to modify the structure of cutting element 800 as shown to foreshorten blades 806, or to move them closer to table 802 so that blades 806 terminate short of the rear of substrate 804. It is also possible to maintain the relative mutual longitudinal orientation of the blades 806 while orienting them radially from a common line (such as the substrate centerline) within substrate 804, so that the blades diverge as they approach the side surface of the substrate 804.

While a variety of exemplary cutting element designs and configurations have been illustrated and described herein, it should be understood that the invention is not limited to use of these specific cutting elements. Other cutting element designs, such as others disclosed in the aforementioned '453, '481, '858 and '704 applications, may also be employed where their characteristics would be beneficial. U.S. Pat. No. 5,351,772, assigned to the assignee of the present invention and incorporated herein by this reference, also discloses a radial-land substrate which is believed to diminish and redistribute tensile stresses at the cutting element periphery and proximate the diamond table/substrate interface, and which therefore may be particularly suitable for placement in those bit locations wherein high axial and combined axial and tensile stresses are experienced.

In short, the invention contemplates the selective use of cutting elements engineered to accommodate and withstand particular types and magnitudes of loading in bit regions where such types and magnitudes of loading are demonstrated. Stated another way, the designer uses as many relevant parameters as are available to him or her to arrive at the net effective stress to which a cutting element at a given location may be subjected, and then selects a suitable cutting element design from those available, or engineers yet another type of cutting element to accommodate that, perhaps unique, stress pattern.

As alluded to above, more than one particular design or configuration of engineered cutting element may be suitable for placement in a particular region or in a transition area between regions, as required, to promote the avoidance of "ring outs" where all of the cutting elements catastrophically fail due to their inability to withstand the loading at the location. Full redundancy (e.g., placement on the same radius) of several different engineered cutting element designs may be employed at particularly high- or variable-stress locations or regions or design methodology depicting the effects of placement of several Cutting element types in a given region may show that such is unnecessary, as the different cutting element types in only partial lateral overlapping relationship of the cutting element paths may provide mutual protection to each other.

By way of further explanation, the present invention contemplates a methodology of cutting element placement so that cutting elements which have the ability to withstand higher axial load components or complex combined axial and tangential loading can be effectively placed on the bit face interior without reducing the aggressiveness of the cutting action, while cutting elements most adapted to withstand predominantly tangential loading may be placed on the flank and shoulder to withstand the higher torsional component of the resultant load on the cutting element. In order to understand the loading of cutting elements at each radius on the bit crown, a good understanding of how the strength of the formation varies from the center to the gage, as depicted in FIGS. 3–5, is essential. An understanding of the formation strength in the region of a cutting element location allows an intelligent prediction of the loading of a particular cutting element for a given set of operating parameters. Complex mathematical modelling provides the components of a resultant load for a given cutting element and location. It has been learned that if the applied loads from cutting the formation are higher than the ability of the cutting element to resist, catastrophic failure occurs. Any given cutting element has an extremely complex residual stress state from the manufacturing process which determines its ability to withstand those loads. A cutting element's residual stress from its high-pressure, high-temperature fabrication in combination with the loading regime resulting from cutting a formation produces a combined stress threshold which can easily be overcome at particular regions of a cutting element. The "engineering" of a cutting element allow the magnitude of those stresses and their location on the cutting element to be altered. The ability of a cutting element to better withstand the loading can be enhanced by reducing the stress levels and locations to accommodate the particular load field applied to the cutting element by the formation.

It is contemplated, as more knowledge is gained about formation stress and the effects of mud, filtration, and cutting mechanics, that in some instances it will be understood that more than one engineered cutting element type may be optimally placed at a given radius and that one, two, three or even more differently-engineered cutting elements may be placed on various regions of the bit crown. Thus, a basic concept of the invention, matching at least one cutting element to one regime or state of borehole stress, may be expanded to encompass the option of employing as many cutting element designs as is necessary or desirable to accommodate the number of different borehole stress regions encountered in a particular drilling scenario and for a particular bit profile.

It is also contemplated that the design principles employed in the present invention may also be applied to the design of so-called tri-cone or "rock" bits, wherein a plurality of bearing-mounted rotatable (usually conical) elements carrying cutting members thereon are caused to rotate by rotation of the bit body by a downhole motor shaft or drill collar to which the rock bit is mounted. It has been observed that cutting members, commonly termed —inserts—, of a rock bit experience differing wear and damage patterns, depending upon their location and thus the stresses and drilling fluid flows to which they are exposed. The complex rotational patterns of rock bit cutting members, due to the rotation of the elements carrying the members superimposed upon the rotation about the bit axis, produce extremely complex and variable stresses in both magnitude and direction. Thus, appropriate modelling of such stresses and resulting insert and cone design modifications may prove equally as beneficial to rock bits as to drag bits. For example, different insert materials, coatings and configurations may be employed in different rows on the cones, and the cones may assume different, nontraditional configurations which are demonstrated to best accommodate the loading experienced and minimize bearing loads. Further, a better understanding of the drilling environment may result in modifications to rock bit body shape and to the selection and placement of hardfacing materials employed to protect the bit bodies against erosion and abrasion.

While the bits depicted and referenced in this application employ threaded shanks for securement to drill collars or drilling motor drive shafts, it is contemplated that other means of securing a drill bit body or crown may be employed, wherein a drill crown may be placed over and secured to a ball or other universal joint means on a drive shaft or at the end of a drill string. Further, other non-threaded type cooperative mounting means such as keys and keyways or lugs and slots may be employed, as appropriate It is also believed that even bit bodies employing interchangeable blades having different cutting element sets to provide different gage diameters and accommodations to different formation characteristics may prove feasible.

In conclusion, it should be affirmed that the mathematical modelling techniques referenced herein and the parameters considered by the inventors in bit design and cutting element selection are known to those of ordinary skill in the art, and the inventors herein do not claim that, for example, modelling of formation rock strength for a given bit profile and other parameters such as design WOB, rotational speed and ROP as well as the other parameters enumerated herein is beyond the skill, ability or resources of those of ordinary skill in the subterranean drilling art. However, the inventors have no knowledge that such design tools have been used in the design methodology disclosed and claimed herein or that an end product of such methodology as disclosed and claimed herein has resulted previously in the art.

Many additions, deletions and modifications may be made to the preferred embodiments of the invention as disclosed herein without departing from the scope of the invention as hereinafter claimed.

What is claimed is:

1. A method of designing a rotary drill bit for drilling a subterranean formation, comprising:

selecting a bit design;

mathematically simulating a rock formation to be drilled with said selected bit design;

determining a magnitude of strength of said simulated rock formation in at least one location adjacent an exterior location on said selected bit design for a proposed set of drilling parameters; and selecting at least one cutting element for placement on said selected bit design at said exterior location, said at least one cutting element possessing a structure adapted to penetrate said simulated rock formation under said proposed set of drilling parameters substantially without damage.

2. The method of claim 1, further comprising determining a magnitude of strength of said simulated rock formation at a plurality of locations adjacent exterior locations on said selected bit design, and selecting at least one cutting element for placement on said bit at each of said plurality of exterior locations, at least a first and a second of said selected cutting elements being structured to penetrate said simulated rock formation under said proposed set of drilling parameters at said different locations having said determined rock strengths substantially without damage.

3. The method of claim 2, wherein at least one of said selected cutting elements is specifically structured to resist bending responsive to tangential stresses on said drill bit.

4. The method of claim 2, wherein at least one of said selected cutting elements is specifically structured to resist shearing responsive to axial stresses on said drill bit.

5. A method of designing a rotary drill bit for drilling subterranean formations, comprising:

selecting a bit design;

mathematically simulating the magnitude and direction of applied stresses to be encountered during drilling at a plurality of locations on said bit by considering at least one load vector at each of said locations, said load vector having a magnitude and having a direction selected from a group of load vector directions including at least one of axial radial and tangential directions; and selecting a cutting element for disposition on said bit at least on one of said plurality of locations, wherein said selected cutting element is specifically structured to withstand said stresses at that location.

6. The method of claim 5, further including mathematically simulating inherent stresses resident in at least one cutting element geometry and mathematically predicting the ability of said at least one cutting element geometry, including said inherent resident stresses, to accommodate the applied stresses from said mathematical simulation at said one location on said bit.

7. The method of claim 5, further including determining wear characteristics of at least one cutting element, comparing said wear characteristics of said at least one cutting element with the anticipated cutting element wear requirements at said at least one location on said bit and determining an extent to which said determined wear characteristics may affect said stresses on said selected cutting element at said one location.

8. The method of claim 5, further including determining thermal loading to be experienced by a cutting element located on at least one of said plurality of locations, determining heat transfer characteristics in each of a plurality of cutting elements from which said cutting element is selected, and employing said determined thermal loading and heat transfer characteristics to predict an extent to which said determined thermal loading may affect the effective stress experienced by said cutting element.

9. The method of claim 5, further including simulating rock strength characteristics of a formation through which said bit is to drill, determining magnitudes of said rock strength adjacent said bit at said plurality of locations, and employing said determined rock strength magnitudes in said mathematical simulation.

10. The method of claim 9, further including determining permeability and filtration characteristics of a formation through which said rock is to drill, and employing said determined permeability and filtration characteristics to predict an extent to which they may affect the rock strength and loading of a cutting element.

* * * * *

UNITED STATES PATENT AND TRADEMARK OFFICE

CERTIFICATE OF CORRECTION

PATENT NO : 6,021,859

DATED : February 8, 2000

INVENTOR(S) : Tibbitts et al.

It is certified that error appears in the above-identified patent and that said Letters Patent are hereby corrected as shown below:

On the Title Page:

In "Related U.S. Application Data", line 4, change "Apr. 25, 1995," to --April 28, 1995--;

In "U.S. Patent Documents", line 1, change "Abblanalp" to --Abplanalp--; and

In "Other Publications", line 2, change "De Beer" to --De Beers--.

Figure 13:
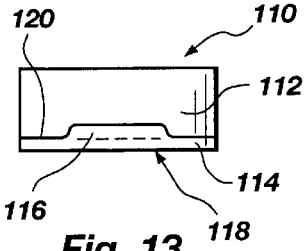
Figure 14:
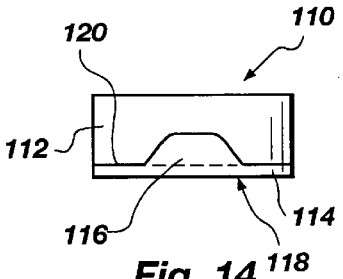

In the Drawings:

In FIG. 13, in left center section, delete "12"; and

In FIG. 18, in left center section, insert reference numeral --216-- at end of lead line currently having no reference numeral.

In the Specification:

| | | |
|---|---|---|
| Column 2, | line 6, | change "stressrelated" to --stress-related--; |
| Column 2, | line 23, | change "tensile" to --tensile--; |
| Column 3, | line 57, | change "decreases" to --decreases--; |
| Column 5, | line 45, | change "impactinduced" to --impact-induced--; |
| Column 5, | line 57, | change "each" to --each--; |
| Column 6, | line 58, | after "retarding" insert --,--; |
| Column 6, | line 59, | after "precluding" insert --,--; |
| Column 6, | line 62, | after "paths" inset --.--; |

(Also Form PTO-1050)

UNITED STATES PATENT AND TRADEMARK OFFICE
CERTIFICATE OF CORRECTION

PATENT NO : 6,021,859
DATED : February 8, 2000
INVENTOR(S) : Tibbitts et al.

It is certified that error appears in the above-identified patent and that said Letters Patent are hereby corrected as shown below:

| | | |
|---|---|---|
| Column 7, | line 1, | delete "in"; |
| Column 8, | line 6, | after "**510**" insert --,--; |
| Column 9, | line 10, | after "to" insert --,-- and after "therefore" insert --,--; |
| Column 9, | line 39, | after "and" insert --,-- and delete "**9**"; |
| Column 10, | line 65, | after "geometries" insert --,--; |
| Column 11, | line 17, | after "characteristics" insert --,-- and after "gradients" insert --,--; |
| Column 11, | line 49, | change "termed reinforcing-portions)" to --termed "reinforcing-portions")--; |
| Column 14, | line 13, | change "of'ROP," to --of ROP,--; |
| Column 14, | line 50, | change "clement" to --element--; |
| Column 15, | line 43, | after "which" insert --,-- and after "therefore" insert --,--; |
| Column 16, | line 1, | change "Cutting" to --cutting--; |
| Column 16, | line 63, | change "--inserts--," to --"inserts",--; and |
| Column 17, | line 24, | after "appropriate" insert --.--. |

UNITED STATES PATENT AND TRADEMARK OFFICE
CERTIFICATE OF CORRECTION

PATENT NO : 6,021,859
DATED : February 8, 2000
INVENTOR(S) : Tibbitts et al.

It is certified that error appears in the above-identified patent and that said Letters Patent are hereby corrected as shown below:

In the Claims:

Claim 2, Column 18, line 6, delete "different" and insert --plurality of-- therefor;

Claim 5, Column 18, line 17, delete "the";

Claim 5, Column 18, line 23, after "axial" insert --,--;

Claim 7, Column 18, line 39, delete "the";

Claim 8, Column 18, line 51, delete "the";

Claim 10, Column 18, line 60, delete "a" and insert --said-- therefor;

Claim 10, Column 18, line 61, delete "rock" and insert --bit-- therefor; and

Claim 10, Column 18, line 63, after "and" insert --determined--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*